US005728955A

United States Patent [19]

Sperzel

[11] Patent Number: 5,728,955

[45] Date of Patent: Mar. 17, 1998

[54] TUNING DEVICE

[76] Inventor: Robert J. Sperzel, 7810 Lake Ave., Cleveland, Ohio 44102

[21] Appl. No.: 706,665

[22] Filed: Sep. 6, 1996

[51] Int. Cl.[6] ..... G10D 3/14

[52] U.S. Cl. ..... 84/306

[58] Field of Search ..... 84/297 R, 304, 84/306

[56] References Cited

U.S. PATENT DOCUMENTS

| | | | |
|---|---|---|---|
| 3,240,098 | 3/1966 | Hepler . | |
| 3,431,807 | 3/1969 | Thompson . | |
| 4,098,163 | 7/1978 | Kato | 84/306 |
| 4,353,280 | 10/1982 | Spercel . | |
| 4,515,059 | 5/1985 | Siminoff | 84/306 |
| 4,528,887 | 7/1985 | Fredrick | 84/306 |
| 4,625,614 | 12/1986 | Spercel . | |
| 4,945,800 | 8/1990 | Schaller | 84/306 |
| 4,970,930 | 11/1990 | Secord | 84/306 |

*Primary Examiner*—Michael L. Gellner

*Assistant Examiner*—Daniel Chapik

*Attorney, Agent, or Firm*—Tarolli, Sundheim, Covell, Tummino & Szabo

[57] ABSTRACT

An improved tuning device includes a housing which a least partially encloses a worm, pinion gear and shaft or string post. The housing includes a main member which encloses the worm and an extension member which is formed separately from the main housing member and encloses the shaft. The extension housing member has a head end portion which is disposed in the main housing member and a shank portion which extends outward from the head end portion. The shank portion of the extension housing member is indented to engage a groove in the shaft. When the tuning device is to be assembled, the extension housing member is deformed into engagement with the groove in the shaft and is then connected with the main housing member. When the extension housing member is to be connected with the main housing member, the extension housing member, shaft and pinion are inserted through an opening in an outer side of the main housing member and then through an opening in an inner side of the main housing member.

46 Claims, 5 Drawing Sheets

TUNING DEVICE

BACKGROUND OF THE INVENTION

The present invention relates to a new and improved tuning device for a string of a musical instrument, such as a guitar.

A known tuning device for a string of a musical instrument is disclosed in U.S. Pat. No. 4,353,280. When the string is to be tuned with this device, the string is inserted through a hole or opening in one end of a shaft or string post. A knob is then manually turned to rotate a worm which is disposed in meshing engagement with a pinion gear. The pinion gear is connected with the shaft. Therefore, rotation of the pinion gear turns the shaft.

In U.S. Pat. No. 4,353,280, the shaft or string post is held against axial movement relative to the housing by deforming one or more portions of the housing into an annular grove in the shaft. Thus, the metal of the housing is pressed into the groove in the shaft so that the shaft is firmly held against axial motion by the indentations and is free to rotate. The indentations also serve to locate a pinion gear with respect to a worm in a housing of the tuning device.

Another known tuning device for a string of a musical instrument is disclosed in U.S. Pat. No. 4,625,614. The tuning device disclosed in this patent has a passage which extends axially through both a shaft or string post and a pinion gear connected with the shaft. A clamp assembly is disposed in the passage. The clamp assembly is actuated to firmly grip the string after it has been manually pulled tight. The manual pretightening of the string enables it to be tuned to the desired pitch by rotating the shaft through a short distance which may be less than one complete revolution.

SUMMARY OF THE INVENTION

The present invention relates to a new and improved device for use in tuning a stringed musical instrument and to a method of assembling the device. The device includes a housing which at least partially encloses a worm, pinion gear and shaft. The housing includes a main housing member which at least partially encloses the worm and an extension housing member which is formed separately from the main housing member and at least partially encloses the shaft.

When the tuning device is to be assembled, the extension housing member may be deformed into engagement with an annular groove in the shaft while the extension housing member is spaced from the main housing member. The main and extension housing members may then be interconnected while the shaft is retained against axial movement relative to the extension housing member by engagement of the extension housing member with the groove in the shaft.

The extension housing member includes a head end portion which is disposed in the main housing member adjacent to the pinion gear. A shank portion of the extension housing member extends outward from the head end portion of the extension housing member. The head end portion of the extension housing member is advantageously disposed in engagement with an inner surface of the main housing member to locate the extension housing member, shaft and pinion gear relative to the main housing member and worm.

When the extension housing member, shaft and pinion gear are to be connected with the main housing member, the extension housing member, shaft and pinion gear may be moved through an opening formed in an outer side of the main housing member. The shank portion of the extension housing member and the shaft are moved through an opening in the inner side of the main housing member.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

Figure 1:
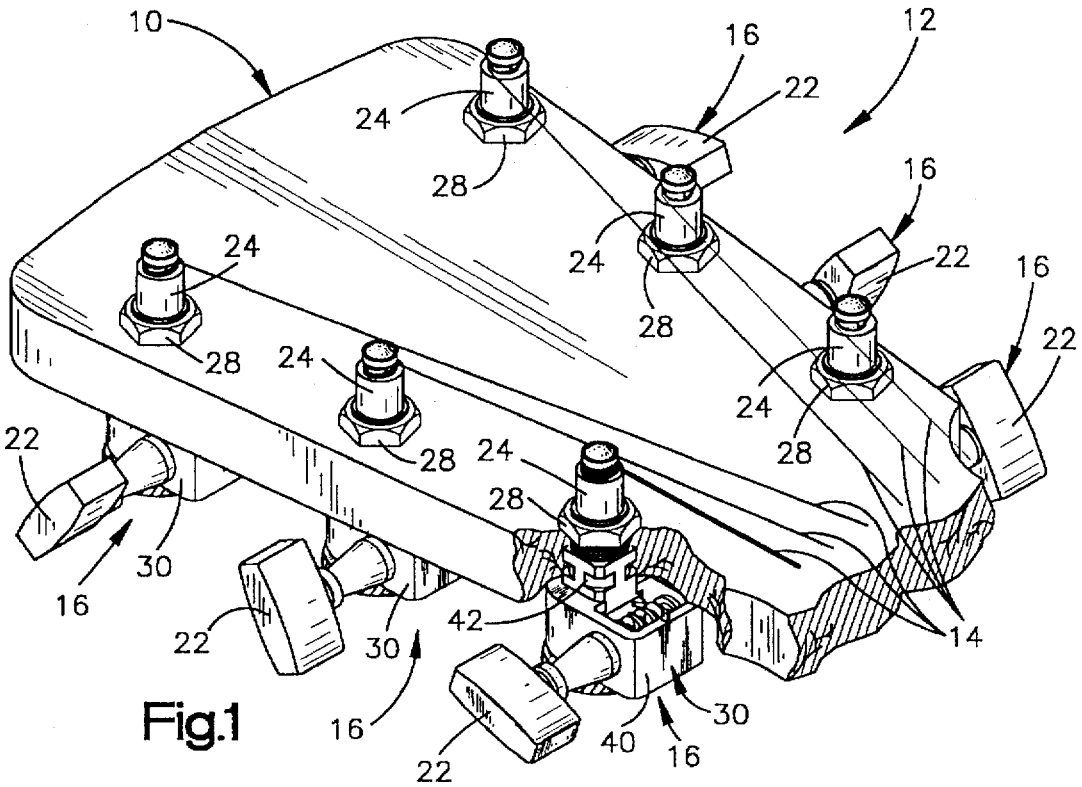
FIG. 1 is a fragmentary illustration of the head end portion of a guitar having tuning devices constructed in accordance with the present invention to vary the tension in strings.

General Description A head end portion 10 of a stringed musical instrument 12 is illustrated in FIG. 1. The specific stringed musical instrument 12 illustrated in FIG. 1 is a guitar having a generally known construction. The guitar has strings 14 which extend from tuning devices 16 constructed and assembled in accordance with the present invention. The strings 14 extend from the head end portion 10 of the stringed musical instrument 12 to a bridge (not shown), which may be a known tremolo bridge system.

Actuation of the tuning devices 16 varies the tension in the strings 14. To actuate the tuning devices 16, knobs 22 are manually rotated. Upon manual rotation of a knob 22 of a tuning device 16, an end portion of one of the strings 14 is wrapped around a string post or shaft 24 which extends from the tuning device. Retainer or barrel nuts 28 are connected with housings 30 of the tuning devices 16 to firmly press the housings against the lower (as viewed in FIG. 1) side of the head end portion 10 of the stringed musical instrument 12.

Each of the identical tuning devices 16 (FIGS. 2 and 3) includes a housing 30 which is constructed and assembled in accordance with a feature of the present invention. The housing 30 at least partially encloses a worm 34, pinion gear 36, and shaft 24.

In accordance with one of the features of the present invention, the housing 30 includes a first or main housing member 40 (FIGS. 2–6) and a second or extension housing member 42 (FIGS. 2, 3, 7 and 8). The extension housing member 42 includes a head end portion 44. The head end portion 44 is disposed in the main housing member 40 adjacent to the pinion gear 36.

A shank portion 46 (FIGS. 2, 3, 7 and 8) of the extension housing member 42 extends outward from the head end portion 44 along the shaft 24. The shank portion 46 has an outer end portion 48 with an external thread convolution 50 which is engaged by one of the retainer or barrel nuts 28 (FIG. 1). The retainer nut 28 clamps the main housing member 40 (FIG. 2) firmly against the head end portion 10 (FIG. 1) of the stringed musical instrument 12.

Figure 3:
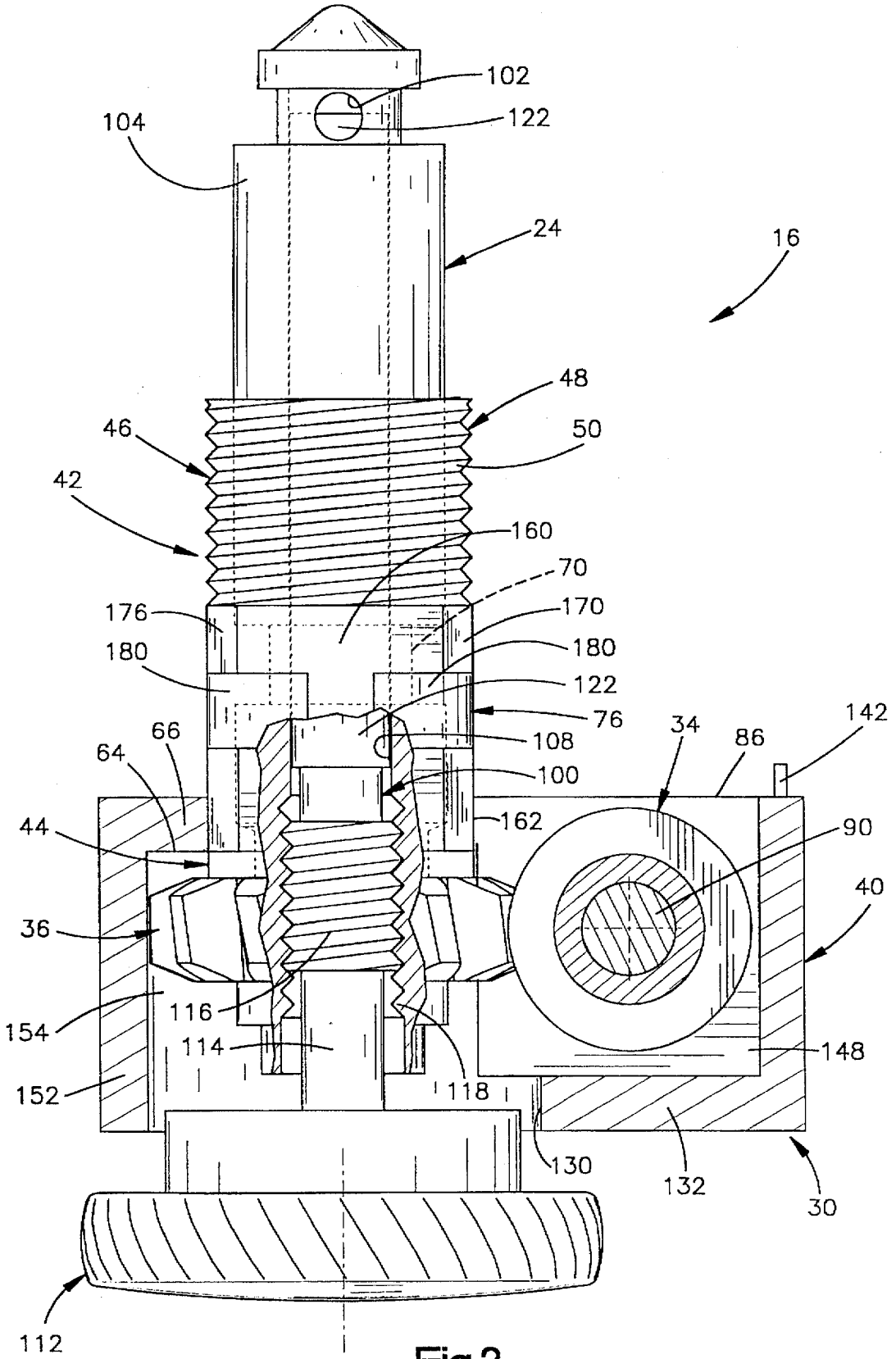
FIG. 3 is an enlarged sectional view, taken generally along the line 3—3 of FIG. 2, further illustrating the construction of the tuning device.

The head end portion 44 (FIG. 8) of the extension housing member 42 has a plurality of side surfaces 54, 56, 58 and 60 (FIG. 8) which face toward the shank portion 46 of the extension housing member 42. The side surfaces 54, 56, 58 and 60 on the head end portion 44 of the extension housing member 42 engage a flat inner side surface 64 (FIG. 3) on an inner side wall 66 of the main housing member 40. The side surfaces 54, 56, 58 and 60 (FIG. 8) on the extension housing member 42 locate the extension housing member 42, pinion gear 36, and shaft 34 relative to the main housing member 40 and worm 34 (FIG. 3).

The side surfaces 54, 56, 58 and 60 (FIG. 8) are disposed in a common plane which extends perpendicular to the central axis 62 (FIG. 7) of the extension housing member 42. In the illustrated embodiment of the extension housing member 42, the side surfaces 54, 56, 58 and 60 (FIG. 8) are generally triangular corner portions of the polygonal head end portion 44 of the extension housing member 42. However, it is contemplated that the head end portion 44 of the extension housing member 42 could have an annular configuration and extend completely around the shank portion 46 of the extension housing member. If this was done, the head end portion 44 of the extension housing member 42 would have a single annular side surface which would extend around the shank portion 46 of the extension housing member 42.

The shank portion 46 of the extension housing member 42 is indented to engage an annular groove 70 (FIGS. 3 and 9) formed in the cylindrical shaft 24. Thus, the shank portion 24 of the extension housing member 42 is plastically deformed or indented radially inward into the groove 70. This interconnects the extension housing member 42 and the shaft 24 in such a manner as to retain the shaft against axial movement relative to the extension housing member while permitting the shaft to freely rotate relative to the extension housing member. If desired, the extension housing member could be connected with the shaft 24 in a different manner. For example, a connection could be provided between an axially outer end of the extension housing member 42 and the shaft 24.

Figure 19:
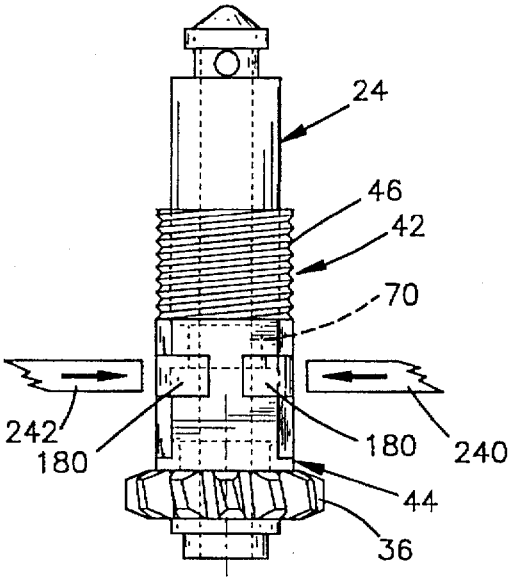
FIG. 19 is a schematic illustration depicting the manner in which a shank portion of the extension housing member of FIGS. 7 and 8 is deformed into engagement with an annular groove in the string post or shaft of FIGS. 9 and 10.
Figure 20:
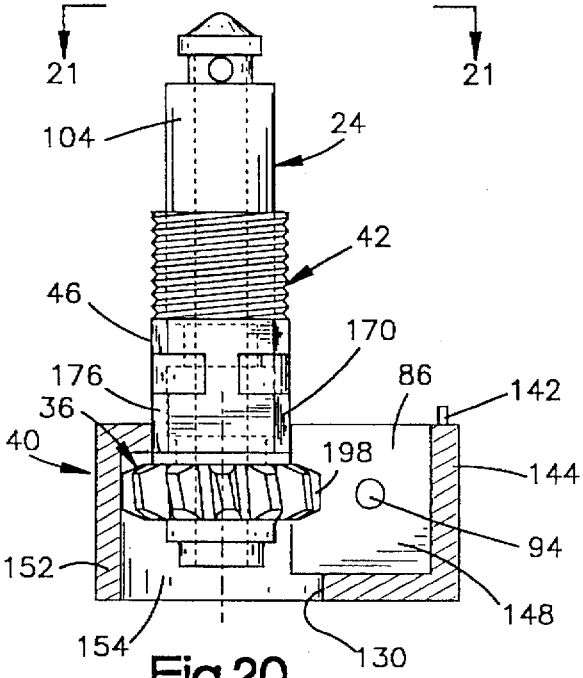
FIG. 20 is a side elevational view depicting the manner in which the extension housing member, shaft and pinion gear of FIG. 19 are positioned in the main housing member of FIGS. 4–6.

Plastic deformation or indenting of the extension housing member 42 is performed while the extension housing member is spaced from the main housing member 40 (FIG. 19). After the extension housing member 42 has been indented to engage the annular groove 70 in the shaft 24, the extension housing member, pinion gear 36 and shaft are mounted as a unit in the main housing member 40 (FIG. 20). Since the indenting of the extension housing member 42 is performed while the extension housing member is spaced from the main housing member 40, it is relatively easy to grip and deform the extension housing member.

Figure 7:
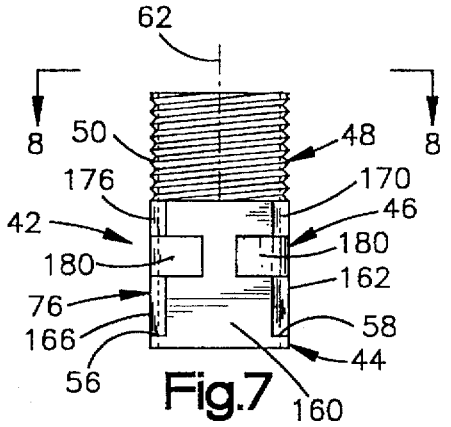
FIG. 7 an elevational view of a second or extension housing member.

The shank portion 46 of the extension housing member 42 includes an inner end portion 76 which has a polygonal configuration (FIGS. 3 and 7). The polygonal inner end portion 76 of the extension housing member 42 engages a portion of a polygonal opening 80 (FIGS. 4, 5 and 6) formed in the inner side wall 66 of the main housing member 40. Engagement of the polygonal inner end portion 76 of the shank portion 46 (FIGS. 7 and 8) of the extension housing member 42 with the polygonal opening 80 (FIGS. 4, 5 and 6) of the main housing member 40 retains the extension housing member 42 against rotation about the central axis 62 of the extension housing member 42.

Although it is preferred to construct the extension housing member 42 (FIGS. 7 and 8) with a polygonal head end portion 44 and a polygonal shank portion 46, it is contemplated that the extension housing member 42 could have a different construction if desired. For example, the inner end portion 76 of the extension housing member 42 could have a cylindrical configuration rather than the illustrated polygonal configuration. Serrations or teeth may be provided in the inner end portion 76 of either a polygonal or cylindrical shank portion 46 of the extension housing member 42 to plastically deform and indent an opening formed in the inner side wall 66 (FIGS. 4–6) of the main housing member 40. If the inner end portion 76 of the shank portion 46 of the extension housing member 42 is formed with a cylindrical configuration, it is believed that it may be desired to form the head end portion 44 of the extension housing member 42 with a circular configuration.

Figure 15:
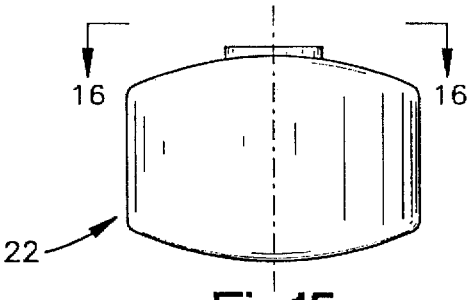
FIG. 15 is a side elevational view of a knob which is connected with the worm support and drive shaft of FIG. 13 in the tuning device of FIGS. 2 and 3.
Figure 16:
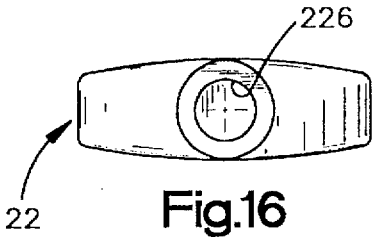
FIG. 16 is an end view, taken generally along the line 16—16 of FIG. 15, further illustrating the construction of the knob.

In accordance with another of the features of the present invention, the worm 34 (FIGS. 2, 3, 11 and 12) is rotatably supported at openings in opposite side walls 86 and 88 (FIGS. 2, 4, 5 and 6) of the main housing member 40. A worm support and drive shaft 90 (FIGS. 2, 3, 13 and 14) extends through the worm 34 into openings 92 and 94 (FIGS. 4, 5 and 6) formed in the parallel side walls 86 and 88 of the main housing member 40. The knob 22 (FIGS. 2, 15 and 16), is fixedly connected with the worm support and drive shaft 90 and is manually rotatable to rotate the worm support and drive shaft 90 and the worm 34 relative to the main housing member 40. Since the worm 34 is disposed in meshing engagement with the pinion gear 36, rotation of the worm 34 rotates the pinion gear 36 and the shaft 24 which is fixedly connected to the pinion gear 36.

A clamp assembly 100 (FIG. 3) grips a string 14 (FIG. 1) which extends through an opening 102 (FIGS. 3 and 9) formed in an outer end portion 104 of the shaft 24. The clamp assembly 100 grips the string 14, after it has been manually tensioned, to enable the string to be quickly and easily tuned with less than one complete turn of the pinion gear 36 and shaft 34.

Figure 17:
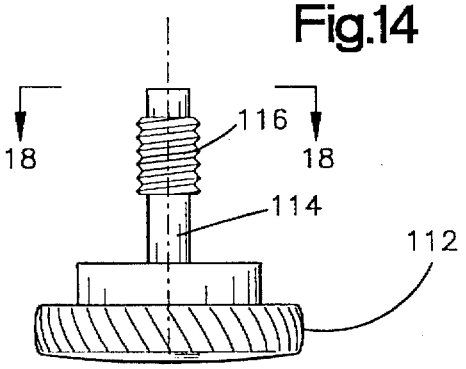
FIG. 17 is a side elevational view of a knob which forms a portion of a string clamp assembly used in the tuning device of FIGS. 2 and 3.
Figure 18:
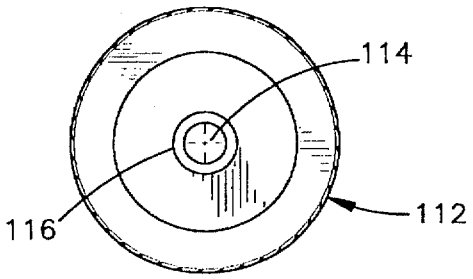
FIG. 18 is an end view, taken generally along the line 18—18 of FIG. 17, further illustrating the construction of the knob.

The clamp assembly 100 is partially disposed in a cylindrical passage 108 (FIGS. 3 and 9) which extends axially through the shaft 24 and pinion 36. A clamp adjustment knob 112 has a stud 114 (FIGS. 3, 17 and 18) which extends axially outwardly from the circular clamp adjustment knob 112. An external thread convolution 116 on the stud 114 engages an internal thread convolution 118 in the passage 108 (FIG. 3). The clamp adjustment knob 112 blocks an opening in the outer side of the main housing member 40 and rotates with the pinion gear 36 and shaft 24.

An inner end of the stud 114 (FIG. 3) engages a cylindrical pin 122 disposed in the passage 108. The pin 102 extends from the inner end of the stud 114 to the opening 102 in the shaft 24. This enables the outer end of pin 122 to engage a string 14 which extends through the opening 102. The construction and the manner in which the clamp assembly 100 is utilized to grip a string 14 is the same as is disclosed in U.S. Pat. No. 4,625,614.

Housing

Figure 4:
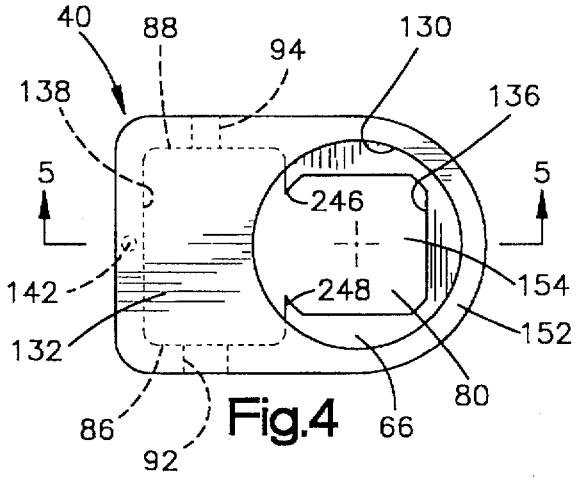
FIG. 4 is a plan view of an outer side of a first or main housing member.
Figure 8:
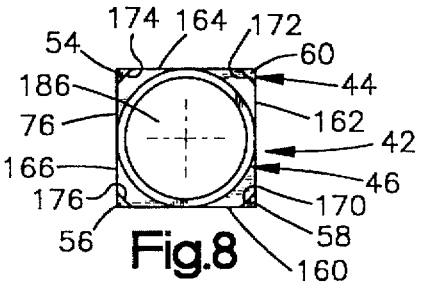
FIG. 8 is a plan view, taken generally along the line 8—8 of FIG. 7, further illustrating the construction of the extension housing member.
Figure 5:
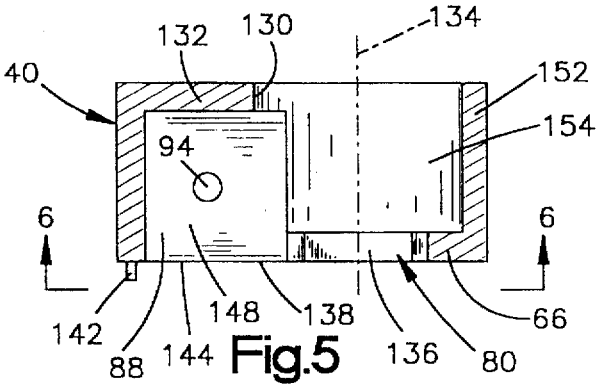
FIG. 5 is a sectional view, taken generally along the line 5—5 of FIG. 4, further illustrating the construction of the main housing member.
Figure 9:
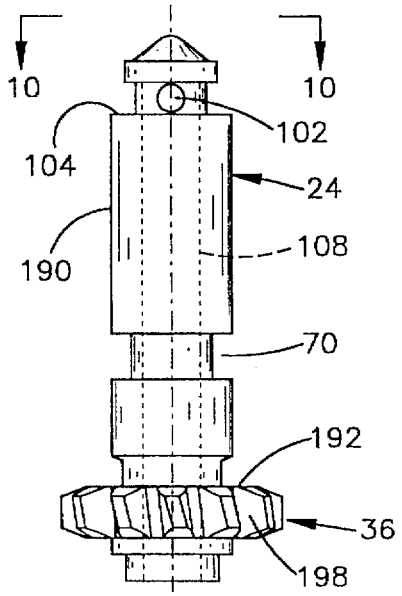
FIG. 9 is a side elevational view of a string post or shaft and pinion gear used in the tuning device of FIGS. 2 and 3.
Figure 10:
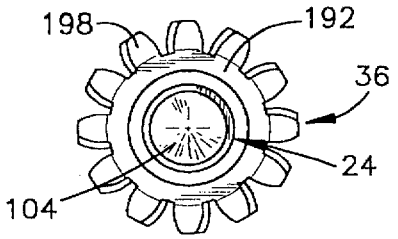
FIG. 10 is a plan view, taken generally along the line 10—10 of FIG. 9, further illustrating the relationship between the shaft and pinion gear.

The housing 30 includes the main housing member 40 (FIGS. 4, 5 and 6) and the extension housing member 42 (FIGS. 7 and 8). The main housing member 40 (FIGS. 4, 5 and 6) is die cast as one piece of metal. The main housing member 40 includes a circular opening 130 which is formed in an outer side wall 132 of the main housing member 40. The circular opening 130 has a central axis 134 (FIG. 5). The circular opening 130 has a diameter which is slightly greater than the maximum diameter of the pinion gear 36 (FIGS. 9 and 10).

The polygonal opening 80 (FIGS. 4, 5 and 6) is formed in the inner side wall 66 of the main housing member 40. The polygonal opening 80 has a relatively small polygonal mounting section 136 (FIG. 6) and a relatively large polygonal insertion section 138. The extension housing member 42 is received in and held against rotation by the polygonal mounting section 136 of the opening 80. Therefore, the polygonal mounting section 136 of the opening 80 has substantially the same configuration and size as the polygonal cross section of the inner portion 76 of the shank portion 46 (FIGS. 7 and 8) of the extension housing member 42.

Figure 11:
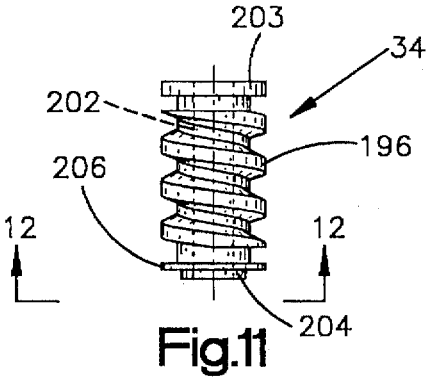
FIG. 11 is a side view of worm used in the tuning device of FIGS. 2 and 3.

The worm 34 is inserted into the main housing member 40 through the polygonal insertion section 138 (FIG. 6) of the opening 80. Therefore, the polygonal insertion section 138 of the opening 80 has a length, as measured between the side walls 86 and 88, which is greater than the axial length of the worm 34 (FIG. 11). Similarly, the polygonal insertion section 138 of the opening 80 has a width which is greater than the maximum diameter of the worm 34.

Figure 2:
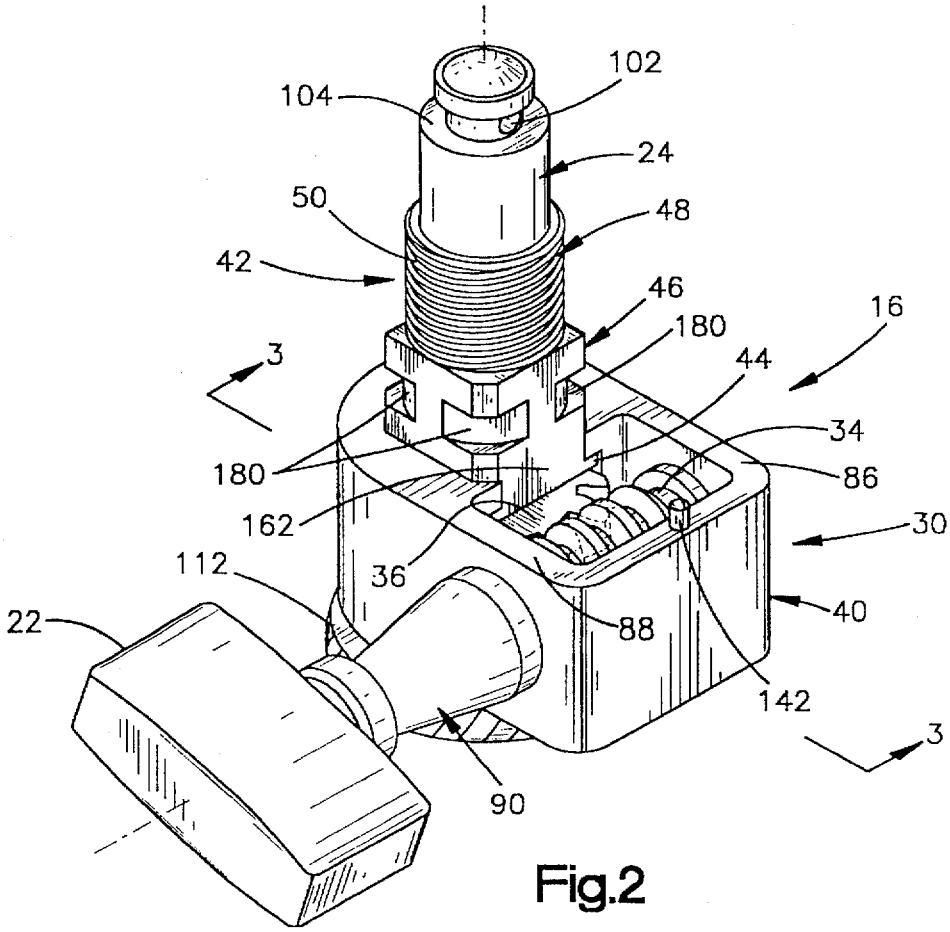
FIG. 2 is an enlarged pictorial illustration of one of the improved tuning devices of FIG. 1.
Figure 6:
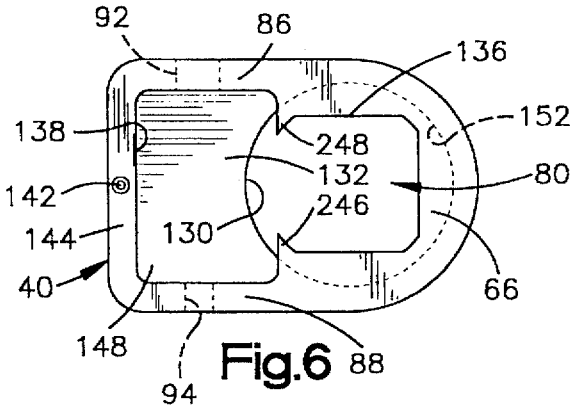
FIG. 6 is a plan view, taken generally along the line 6—6 of FIG. 5, of an inner side of the main housing member.
Figure 12:
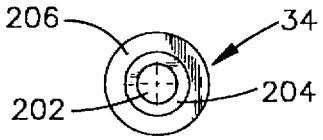
FIG. 12 is an end view, taken generally along the line 12—12 of FIG. 11, further illustrating the construction of the worm.
Figure 13:
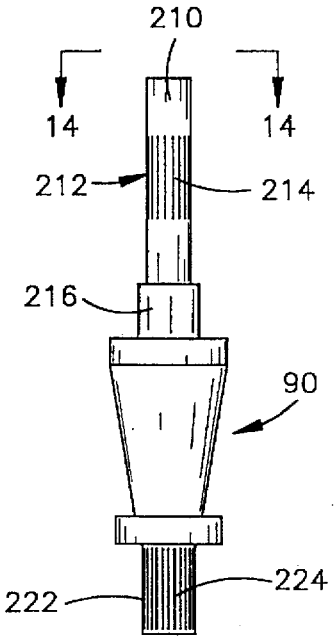
FIG. 13 is a side elevational view of a worm support and drive shaft which is used in the tuning device of FIGS. 2 and 3.
Figure 14:
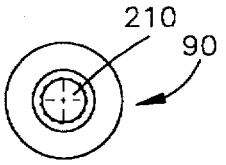
FIG. 14 a plan view, taken generally along the line 14—14 of FIG. 13, further illustrating the construction of the worm support and drive shaft.

The worm 34 (FIGS. 2, 3, 11 and 12) is supported in the main housing member 40 by the worm support and drive shaft 90 (FIGS. 2, 13 and 14). The worm support and drive shaft 90 extends between the coaxial circular openings 92 and 94 formed in the side walls 86 and 88 of the main housing member 40 (FIGS. 4, 5 and 6). Although the central axis of the circular opening 94 is coincident with the central axis of the circular opening 92, the opening 94 has a smaller diameter than the opening 92.

A cylindrical retainer pin 142 extends from a flat end wall 144 (FIGS. 5 and 6) of the main housing member 40. The flat end wall 144 cooperates with the two side walls 86 and 88 to form a generally rectangular worm chamber 148 (FIGS. 5 and 6) in which the worm 34 is rotatably mounted (FIG. 3). The side walls 86 and 88 cooperate with an arcuate end wall 152 (FIGS. 4, 5 and 6) to partially define a generally cylindrical pinion gear chamber 154 in which the pinion gear 36 is received (FIG. 3). The pinion gear chamber 154 has a diameter which is the same as the diameter of the opening 130.

The extension housing member 42 (FIGS. 7 and 8) is machined from a single piece of metal, such as brass. The extension housing member 42 has an inner end portion 76 with a generally rectangular configuration. Thus, the inner end portion 76 of the shank portion 46 of the extension housing member 42 includes four flat side surfaces 160, 162, 164 and 166 (FIGS. 7 and 8) disposed in a square array. The flat rectangular side surfaces 160, 162, 164 and 166 extend into and form part of the head end portion 44 of the extension housing member and extend along the shank portion 46 of the extension housing member. Flat corner surfaces 170, 172, 174, and 176 extend between the flat side surfaces 160–166. The corner surfaces 170–176 are skewed at an angle of 45° to the side surfaces 160–166.

A plurality (four) identical recesses 180 (FIG. 7) are machined into the shank portion. The recesses 180 weaken the side wall of the shank portion 46 to facilitate plastic deformation of the shank portion.

The head end portion 44 of the extension housing member 42 has a rectangular (square) configuration formed by the flat side surfaces 160–166. The side surfaces 54, 56, 58 and 60 (FIG. 8) are formed on the head end portion 44 where the corner surfaces 170–176 are machined into the shank portion 46 of the extension housing member 42. A cylindrical central passage 186 extends through the extension housing member 42.

Shaft and Pinion Gear

In the illustrated embodiment of the invention, the shaft 24 and pinion gear 36 (FIGS. 9 and 10) are formed separately from each other and are fixedly interconnected in a coaxial relationship. However, the shaft 24 and pinion gear 36 could be integrally formed as one piece if desired. The shaft 24 has a cylindrical outer side surface 190 in which the groove 70 is formed.

The passage 108 (FIG. 9) extends axially through the shaft 24 to the outer end portion 104 of the shaft. The cylindrical passage 108 terminates in the outer end portion 104 of the shaft. The axially extending passage 108 is intersected by the radially extending opening 102. The opposite end of the cylindrical passage 108 is open to enable the cylindrical pin 122 and stud 114 on the clamp adjustment knob 112 (FIG. 3) to be received in the passage. The pinion gear 36 has a flat circular inner side surface 192 which is coaxial with the shaft 24 and faces toward the outer end portion 104 of the shaft.

Worm and Drive Shaft

The worm 34 (FIGS. 11 and 12) meshes with the pinion gear 36 (FIG. 3). The worm 34 is machined from a single piece of metal, such as brass, and has an external thread convolution 196 (FIG. 11) which engages radially projecting teeth 198 (FIG. 10) on the pinion gear 36. A passage 202 (FIGS. 11 and 12) extends axially through the worm 34.

At one end of the worm 34, a spring washer mounting projection 204 is formed. The spring washer mounting projection 204 is integrally formed with the worm 34 and extends axially outward from a circular wall 206 at one end of the worm. The spring washer mounting projection 204 has a generally cylindrical configuration and is adapted to engage an opening in an annular spring washer having side surfaces with an arcuate bowed configuration.

The worm support and drive shaft 90 (FIGS. 13 and 14) is machined from one piece of metal. The worm support and drive shaft 90 has a cylindrical end portion 210 which is received in the circular opening 94 (FIGS. 4 and 5) formed in the side wall 88 of the main housing member 40. A body section 212 of the worm support and drive shaft 90 has a plurality of axially extending serrations 214. The serrations 214 are engageable with the inner side surface of the passage 202 (FIGS. 11 and 12) through the worm 34 to fixedly connect the worm support and drive shaft 90 with the worm.

A shoulder 216 on the worm support drive shaft 90 (FIG. 13) has a cylindrical configuration. The shoulder 216 has a diameter which is greater than the diameter of the cylindrical end portion 210 of the worm support drive shaft 90. The shoulder 216 is received in the opening 92 (FIG. 6) formed in the side wall 86. Since the shoulder 216 has a larger diameter than the end portion 210 of the worm support and drive shaft 90, the opening 92 in the side wall 86 of the main housing member 40 has a larger diameter than the opening 94 in the side wall 88 of the main housing member.

An outer end portion 222 of the worm support drive shaft 90 has axially extending serrations 224 which are engageable with an inner side surface of a circular opening 226 (FIG. 16) formed in the knob 22. Engagement of the serrations 224 with the opening 226 in the knob 22 results in the knob being fixedly connected with the worm support and drive shaft 90. In the illustrated embodiment of the invention, the knob 22 (FIGS. 15 and 16) has a generally rectangular configuration. It is contemplated that the knob 22 could have a different configuration if desired and could be connected with the worm support and drive shaft 90 in a different manner if desired. For example, the knob 22 could be integrally formed as one piece with the worm support and drive shaft 90.

Assembly

When the tuning device 16 is to be assembled, the extension housing member 42 (FIG. 19) is connected with the shaft 24 and pinion gear 36 while the extension housing member is in a spaced apart relationship with the main housing member 40. The extension housing member 42 is telescopically moved onto the shaft 24 until the head end portion 44 of the extension housing member 42 is disposed in abutting engagement with the flat side surface 192 (FIGS. 9 and 10) on the pinion gear 36. When the head end portion 44 (FIG. 19) of the extension housing member 42 is in engagement with the pinion gear 36, the recesses 180 in the shank portion 46 of the extension housing member 42 are partially aligned with the groove 70 in the shaft 24.

A pair of forming tools 240 and 242 (FIG. 19) are moved into engagement with the recesses 180. The forming tools 240 and 242 are pressed against the extension housing member 42. Pressure applied against the extension housing member 42 plastically deforms the metal of the extension housing member 42 into engagement with the radially extending sides of the groove 70 in the shaft 24.

The forming tools 240 and 242 are dimensioned to assure close abutting engagement between projections formed on the inside of the extension housing member 42 and the groove 70. Since the deformation of the extension housing member 42 occurs while the extension housing member is spaced from the main housing member 40, gripping the extension housing member and deforming the extension housing member with the tools 240 and 242 is facilitated.

It is contemplated that a punch may be moved into engagement with the shank portion 46 of the extension housing member 42 at a location which is radially aligned with the groove 70 to assure that there is a secure interlock between the shaft 24 and the groove. By having the recesses 180 axially offset relative to the groove 70, the flow of metal of the extension housing member 42 into the groove does not jam the head end portion 44 of the extension housing member 42 against the pinion gear 36. This enables the pinion gear 36 and shaft 24 to freely rotate relative to the extension housing member 42 after the material of the extension housing member has been plastically deformed by the forming tools 240 and 242. Although it is preferred to interconnect the extension housing member 42 and shaft 24 by plastically deforming the extension housing member, they may be interconnected in a different manner if desired.

After the extension housing member 42 has been connected with the shaft 24, the shaft 24, extension housing member 42, and pinion gear 36 are moved as a unit through the circular opening 130 into the pinion gear chamber 154 in the main housing member 40. The outer end portion 104 of the shaft 24 is leading as it is moved into the opening 130.

The shaft 24 and the shank portion 46 of the extension housing member 42 are then moved into the mounting section 136 (FIG. 6) of the polygonal opening 80 in the inner side wall 66 of the main housing member 40. As this occurs, the corner surfaces 170, 172, 174 and 176 (FIG. 8) on the shank portion 46 of the extension housing member 42 move into interfering engagement with corner surfaces of the mounting section portion 136 of the polygonal opening 80. There is a very tight fit, but not an interference fit, between the flat side surfaces 160, 162, 164 and 166 on the shank portion 46 of the extension housing member 42 and flat side surfaces of the mounting section 136 of the polygonal opening 80.

Since there is only interference between the corner surfaces 170–176 on the shank portion 46 of the extension housing member 42 and surfaces on the mounting section 136 of the polygonal opening 80 in the main housing member 40, movement of the shank portion 46 of the extension housing member 42 into the mounting section 136 of the polygonal opening 80 is facilitated. However, the interference at the corner surfaces 170–176 of the extension housing member 42 with the main housing member 40 retains the extension housing member in a desired position relative to the main housing member. In addition, the interference fit between the corner surfaces 170–176 of the extension housing member 42 and the main housing member 40 retains the extension housing member 42 against rotational movement relative to the main housing member.

As the extension housing member 42 is moved into the main housing member 40, the head end portion 44 of the extension housing member moves into engagement with the inner side wall 66 of the main housing member. The side surfaces 54–60 (FIG. 8) on the head end portion 44 of the extension housing member 42 move into abutting engagement with the inner side wall 66 (FIGS. 5 and 6) of the main housing member 40. This positions the pinion gear 36 in the pinion gear chamber 154. This also positions the extension housing member 42 axially relative to the main housing member 40.

Figure 21:
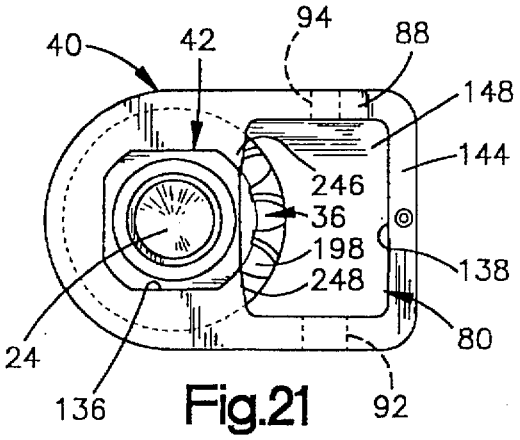
FIG. 21 is a plan view, taken generally along the line 21—21 of FIG. 20, further illustrating the relationship between the extension housing member, shaft, pinion gear and main housing member.

Once the extension housing member 42, shaft 24 and pinion gear 36 have been positioned relative to the main housing member 40, in the manner illustrated in FIG. 20, a pair of tabs or ears 246 and 248 (FIG. 21) are indented or plastically deformed against the extension housing member 42. This further locks the extension housing member 42 against movement relative to the main housing member 40.

Figure 22:
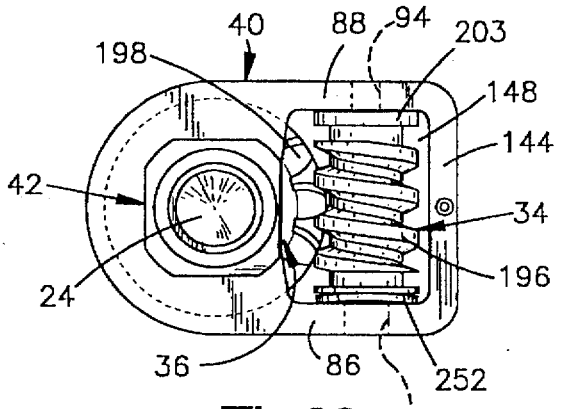
FIG. 22 a plan view, generally similar to FIG. 21, illustrating the manner in which the worm of FIGS. 11 and 12 and a spring washer are inserted into the main housing member.

An annular spring washer 252 (FIG. 22) is mounted on the cylindrical projection 204 (FIG. 11) extending from the end portion of the worm 34. The spring washer 252 is positioned on the projection 204 with the arcuate bow in the annular spring washer toward the worm 34.

The worm 34 and spring washer 252 are then positioned in the worm chamber 148 in the main housing member 40 (FIG. 22) as a unit. The cylindrical end portion 203 (FIG. 11) of the worm 34 is positioned in abutting engagement with the side wall 88 (FIG. 22) of the main housing member 40. The helical external thread convolution 196 on the worm 34 is positioned in engagement with the teeth 198 on the pinion gear 36.

The spring washer 252 (FIG. 22) engages the side wall 88 of the main housing member 40. This enables the spring washer 252 to press the worm 34 against the side wall 88 of the main housing member 40 to eliminate tolerances or end play in the direction in which reaction forces are transmitted from the worm to the main housing member 40. During tightening of a string 14 on the musical instrument 12 (FIG. 1), the reaction forces between the pinion gear 36 and worm 34 are such as to urge the worm axially toward the side wall 88 of the main housing member 40.

Figure 23:
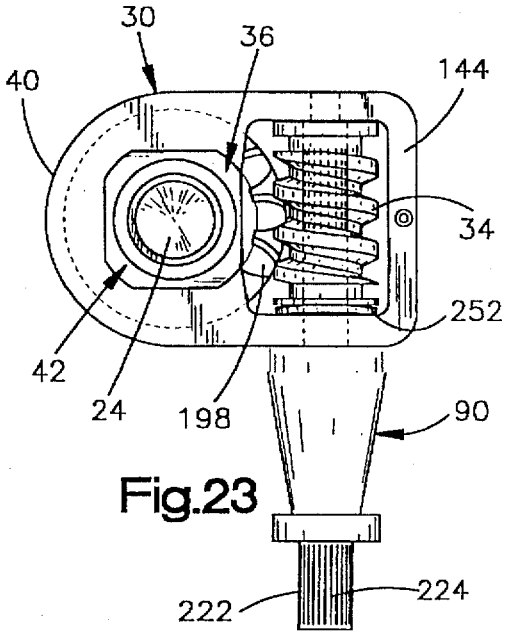
FIG. 23 is a plan view, generally similar to FIG. 22, illustrating the manner in which the worm support and drive shaft of FIGS. 13 and 14 is connected with the worm after the worm has been positioned in the housing in the manner shown in FIG. 22.

After the worm 34 has been positioned in the main housing member 40 in engagement with the pinion gear 36, the worm support and drive shaft 90 is inserted through the opening 92 (FIG. 22) in the side wall 86 of the main housing member 40 into the worm 34 (FIG. 23). The end portion 210 (FIG. 13) of the worm support and drive shaft 90 moves into the opening 94 (FIG. 22) in the opposite side wall 88 of the main housing member 40. As this occurs, the shoulder 216 (FIG. 13) on the worm support and drive shaft 90 moves into engagement with the opening 92 (FIG. 22) in the main housing member 40.

As the worm support and drive shaft 90 is inserted into the worm 34, the serrations 214 (FIG. 13) on the worm support and drive shaft 90 plastically deform the metal on the inside of the passage 202 (FIGS. 11 and 12). The worm 34 is fixedly connected to the worm support and drive shaft 90 by the serrations 214. The worm 34 is supported by the shaft 90. The shaft 90 is rotatably supported by the side walls 86 and 88 of the main housing member 40.

After the worm support and drive shaft 90 has been inserted into the worm 34 and main housing member 40 in the manner illustrated in FIG. 23, the knob 22 (FIGS. 15 and 16) is pressed onto the serrations 224 on the end portion 222 of the worm support and drive shaft. As this occurs, the serrations 224 plastically deform the inner side surface of the opening 226 (FIG. 16) in the knob 22. The serrations 224 fixedly interconnect the knob 22 and the worm support and drive shaft 90.

The pin 122 (FIG. 3) of the clamp assembly 100 is inserted into the passage 108 in the shaft 24. The external thread convolution 116 on the stud 114 is turned into threaded engagement with the internal thread convolution 118 in the shaft 24. As this occurs, the clamp adjustment knob 112 moves into and blocks the opening 130 to the pinion gear chamber 154. The clamp adjustment knob 112 is rotatable in the opening 130 during rotation of the pinion gear 36 in the pinion gear chamber 154.

Once the tuning device 16 (FIG. 2) has been assembled in the manner previously explained, the tuning device may be mounted on the head end portion 10 of a stringed musical instrument 12. When the tuning device is mounted on the head end portion 10 of the stringed musical instrument, the housing 30 is positioned in engagement with a lower (as viewed in FIG. 1) side surface of the head portion 10. The shank portion 46 of the extension housing member 42 extends through an opening in the head end portion 10 of the stringed musical instrument 12.

A retainer or barrel nut 28 is then turned onto the thread convolution 50 on the outer end portion 48 of the shank portion 46 of the extension housing member 42. As the retainer or barrel nut 28 is tightened, the main housing member 40 is pressed firmly against the lower side surface of the head end portion 10 of the stringed musical instrument 12 by the head end portion 44 of the extension housing member 42. The pin 142 (FIGS. 2 and 3) is pressed into the head end portion 10 of the stringed musical instrument 12 (FIG. 1). This results in the main housing member 40 being firmly held against the movement relative to head end portion 10 of the stringed musical instrument 12.

Conclusion

In view of the foregoing description, it is apparent that the present invention provides a new and improved device 16 for use in tuning a stringed musical instrument 12 and a method of assembling the device. The device 16 includes a housing 30 which at least partially encloses a worm 34, pinion gear 36 and shaft 24. The housing 30 includes a main housing member 40 which at least partially encloses the worm 34 and an extension housing member 42 which is formed separately from the main housing member and at least partially encloses the shaft 24.

When the tuning device 16 is to be assembled, the extension housing member 42 may be deformed into engagement with an annular groove 70 in the shaft 24 while the extension housing member is spaced from the main housing member 40. The main and extension housing members 40 and 42 may then be interconnected while the shaft 24 is retained against axial movement relative to the extension housing member by engagement of the extension housing member 42 with the groove 70 in the shaft 24.

The extension housing member 42 includes a head end portion 44 which is disposed in the main housing member 40 adjacent to the pinion gear 34. A shank portion 46 of the extension housing member 42 extends outward from the head end portion 44 of the extension housing member. The head end portion 44 of the extension housing member 42 is advantageously disposed in engagement with an inner surface 64 of the main housing member 40 to locate the extension housing member, shaft 24 and pinion gear 36 relative to the main housing member and worm 34.

When the extension housing member 42, shaft 24 and pinion gear 36 are to be connected with the main housing member 40, the extension housing member, shaft 24 and pinion gear 36 may be moved through an opening 130 formed in an outer side 132 of the main housing member 40. The shank portion 46 of the extension housing member 42 and the shaft 24 are moved through an opening 80 in the inner side 66 of the main housing member 40.

Having described the invention, the following is claimed:

1. A device for use in tuning a stringed musical instrument, said device comprising a rotatable shaft having a first end portion adapted to be connected with a string of the musical instrument and a second end portion, a pinion gear connected with the second end portion of said shaft, a worm disposed in meshing engagement with said pinion gear, said worm being rotatable to rotate said pinion gear and shaft to vary tension in the string connected with the first end portion of said shaft, and a housing at least partially enclosing said worm, pinion gear and shaft, said housing including a first housing member which at least partially encloses said worm and a second housing member which is formed separately from said first housing member and which at least partially encloses said shaft, said second housing member including a head end portion which is disposed in said first housing member and a shank portion which extends outward from said head end portion of said second housing member along said shaft, said head end portion of said second housing member having a side surface which faces toward said shank portion of said second housing member and is disposed in engagement with an inner surface of said first housing member, said shaft having an annular groove disposed intermediate said first and second end portions, said shank portion of said second housing member including an indentation which extends into said groove to retain said shaft against axial movement relative to said shank portion of said second housing member.

2. A device as set forth in claim 1 wherein said first housing member includes first and second walls disposed adjacent to axially opposite ends of said worm, said first wall including first surface means for defining a first circular opening having a first diameter, said second wall including second surface means for defining a second circular opening having a second diameter which is larger than said first diameter, said worm having a central passage which is axially aligned with said first and second circular openings, said device further including a drive shaft extending into said first and second circular openings in said first and second walls of said first housing member and through said passage in said worm to support said worm for rotation relative to said first housing member, said drive shaft having a first circular portion which is disposed in said first opening in engagement with said first surface means and a second circular portion which is disposed in said second opening in engagement with said second surface means, said second circular portion of said shaft having a larger diameter than said first circular portion of said drive shaft, means for connecting said drive shaft with said worm, and manually engageable means connected with said drive shaft for transmitting force to said drive shaft to rotate said drive shaft and worm relative to said first housing member.

3. A device as set forth in claim 2 further including a spring washer disposed between one end portion of said worm and one of said first and second walls of said first housing member, said spring washer having central opening through which said drive shaft extends, said spring washer having arcuately bowed opposite side surfaces, one of said side surfaces of said spring washer being disposed in engagement with said one end portion of said worm and one of said side surfaces of said spring washer being disposed in engagement with said one of said first and second walls of said first housing member to enable said spring washer to urge an end portion of said worm opposite from said one end portion into engagement with a wall of said first housing member opposite from said one of said first and second walls of said first housing member.

4. A device as set forth in claim 3 wherein said one end portion of said worm has a circular projection which extends into said central opening in said spring washer to position said spring washer relative to said worm.

5. A device as set forth in claim 2 wherein said means for connecting said drive shaft with said worm includes a plurality of splines formed on said drive shaft at a location between said first and second circular portions of said drive shaft, said plurality of splines being disposed in engagement with said worm to interconnect said worm and drive shaft.

6. A device as set forth in claim 1 wherein said first housing member includes an inner wall through which said second housing member extends and an outer wall opposite from said inner wall, said inner wall of said first housing member having a surface which engages said shank portion of said second housing member to retain said second housing member against rotation relative to said first housing member.

7. A device as set forth in claim 6 wherein said surface on said inner wall of said first housing member has a linear configuration and is disposed in engagement with a surface on said second housing member having a linear configuration.

8. A device as set forth in claim 6 wherein a portion of said shank portion of said second housing member which extends through said bottom wall of said first housing member has a polygonal configuration and is at least partially disposed in an opening in said inner wall of said first housing member.

9. A device as set forth in claim 8 wherein said head end portion of said second housing member has a polygonal configuration and is disposed in engagement with said inner wall of said first housing member.

10. A device as set forth in claim 6 wherein said outer wall of said first housing member has a circular opening which is axially aligned with said shaft and with said shank portion of said second housing member, said circular opening in said outer wall of said first housing member having a diameter which is greater than a maximum diameter of said pinion gear to enable said pinion gear to be inserted into said first housing member through said circular opening in said outer wall of said first housing member.

11. A device as set forth in claim 1 wherein said first housing member includes an inner portion in which a first opening is formed and an outer portion in which a second opening is formed, said shank portion of said second housing member being partially disposed in said first opening in said inner portion of said first housing member, said second opening in said outer portion of said first housing member being axially aligned with a central axis of said shaft.

12. A device as set forth in claim 11 wherein at least a portion of said first opening in said bottom portion of said first housing member is aligned with said worm and is large enough to enable said worm to be inserted into said first housing member through said first opening.

13. A device as set forth in claim 11 wherein said first opening in said bottom portion of said first housing member is larger than and has a different configuration than said second opening in said upper portion of said first housing member.

14. A method of assembling a device for use in tuning a stringed musical instrument and wherein the device has a first housing member which at least partially encloses a worm and pinion gear and a second housing member which at least partially encloses a rotatable shaft connected with the pinion gear, said method comprising the steps of retaining the shaft against axial movement relative to the second housing member by deforming the second housing member into engagement with an annular groove in the shaft with the second housing member spaced from the first housing member, and interconnecting the first and second housing members after retaining the shaft against axial movement relative to the second housing member by deforming the second housing member.

15. A method as set forth in claim 14 wherein said step of interconnecting the first and second housing members includes moving the second housing member into the first housing member and locating the second housing member and shaft relative to the first housing member by engaging a surface on the first housing member with a surface on the second housing member while the shaft is retained against axial movement relative to the second housing member.

16. A method as set forth in claim 14 further including the steps of connecting the pinion gear with an end portion of the shaft prior to performance of said step of retaining the shaft against axial movement relative to the second housing member, said step of interconnecting the first and second housing members includes positioning the pinion gear in said first housing member with the pinion gear connected with the end portion of the shaft.

17. A method as set forth in claim 16 wherein said step of retaining the shaft against axial movement relative to the second housing member includes effecting relative movement between the shaft and second housing member in a direction parallel to a central axis of the shaft until a surface on the second housing member and a surface connected with the pinion gear are disposed in engagement, said step of deforming the second housing member being performed with the surface on the second housing member and the surface connected with the pinion gear in engagement.

18. A method as set forth in claim 14 wherein the second housing member has a head end portion and a shank portion which extends outward from said head end portion, said step of interconnecting the first and second housing members includes engaging the first housing member with the head end portion of the second housing member to block axial movement of the second housing member and shaft in at least one direction relative to the first housing member and engaging the shank portion of the second housing member with the first housing member to retain the second housing member against rotation relative to the first housing member.

19. A method as set forth in claim 14 wherein said step of interconnecting the first and second housing members includes moving the shaft and second housing member through an opening formed in a first side of the first housing member and moving at least a portion of the shaft and second housing member through an opening formed in a second side of the first housing member so that at least a portion of the second housing member and shaft extend outward from the second side of the first housing member.

20. A method as set forth in claim 19 further including engaging the second housing member with the first housing member to retain the second housing member against rotation relative to the first housing member.

21. A method as set forth in claim 19 further including connecting a circular member with the shaft and blocking the opening in the first side of the first housing member with the circular member.

22. A method as set forth in claim 19 further including the step of moving the worm into the first housing member through the opening formed in the second side of the first housing member.

23. A method as set forth in claim 22 wherein said step of moving the worm into the first housing member through the opening in the second side of the first housing member is performed with a spring washer axially aligned with the worm.

24. A method of assembling a device for use in tuning a stringed musical instrument and wherein the device has a first housing member which at least partially encloses a worm and pinion gear and a second housing member which at least partially encloses a rotatable shaft connected with the pinion gear, said method comprising the steps of positioning the shaft in the second housing member, moving the shaft and second housing member through an opening formed in a first side of the first housing member with the pinion gear connected with the shaft, and moving at least a portion of the shaft and at least a portion of the second housing member through an opening formed in a second side of the first housing member so that at least a portion of the second housing member and shaft extend outward from the second side of the first housing member.

25. A method as set forth in claim 24 further including moving the worm into the first housing member through the opening formed in the second side of the first housing member.

26. A method as set forth in claim 24 further including blocking the opening in the first side of the first housing member with a member which is connected to and is rotatable with the shaft relative to the first housing member.

27. A method as set forth in claim 24 further including engaging the second housing member with the first housing member to retain the second housing member against rotation relative to the first housing member.

28. A method as set forth in claim 24 further including retaining the shaft against axial movement relative to the second housing member by deforming the second housing member into engagement with an annular groove in the shaft.

29. A device for use in tuning a stringed musical instrument, said device comprising a rotatable shaft having a first end portion adopted to be connected with a string of the musical instrument and a second end portion, a pinion gear connected with the second end portion of said shaft, a worm disposed in meshing engagement with said pinion gear, said worm being rotatable to rotate said pinion gear and shaft to vary tension in the string connected with the first end portion of said shaft, and a housing at least partially enclosing said worm, pinion gear and shaft, said housing including a first housing member which at least partially encloses said worm and a second housing member which is formed separately from said first housing member and which at least partially encloses said shaft, said second housing member including a head end portion which is disposed in said first housing member and a shank portion which extends outward from said head end portion of said second housing member along shaft, said first housing member including an inner wall through which said second housing member extends and an outer wall opposite from said inner wall, said outer wall having an opening through which said pinion gear and second housing member are movable into said first housing member, said inner wall of said first housing member having a surface which engages said second housing member to retain said second housing member against rotation relative to said first housing member and a surface which engages said head end portion of said second housing member to block movement of said second housing member relative to said first housing member in a direction extending parallel to a central axis of said shaft.

30. A device as set forth in claim 29 further including a circular member blocking the opening in said outer wall, said circular member being connected with said shaft for rotation therewith relative to said first and second housing members.

31. A device as set forth in claim 29 wherein said surface on said first housing member which engages said shank portion of said second housing member has a linear configuration and is disposed in engagement with a surface on said shank portion of said second housing member having a linear configuration.

32. A device as set forth in claim 29 wherein said shaft his an annular groove disposed intermediate said first an second end portions, said shank portion of said second housing member including an indentation which extends into said groove to retain said shaft against axial movement relative said shank portion of said second housing member.

33. A device for use in tuning a stringed musical instrument, said device comprising a rotatable shaft having a first end portion adapted to be connected with a string of the musical instrument and a second end portion, a pinion gear connected with the second end portion of said shaft, a worm disposed in meshing engagement with said pinion gear, said worm being rotatable to rotate said pinion gear and shaft to vary tension in the string connected with the first end portion of said shaft, and a housing at least partially enclosing said worm, pinion gear and shaft, said housing including a first housing member which at least partially encloses said worm and a second housing member which is formed separately from said first housing member and which at least partially encloses said shaft, said second housing member including a head end portion which is disposed in said first housing member and a shank portion which extends outward from said head end portion of said second housing member along said shaft, said head end portion of said second housing member having a side surface which overlaps an inner surface of said first housing member to block axial movement of said second housing member in at least one direction relative to said first housing member.

34. A device as set forth in claim 33 wherein said first housing member includes first and second walls disposed adjacent to axially opposite ends of said worm, said first wall including first surface means for defining a first circular opening, said second wall including second surface means for defining a second circular opening, said worm having a central passage which is axially aligned with said first and second circular openings, said device further including a drive shaft extending into and disposed in engagement with said first and second circular openings in said first and second walls of said first housing member and through said passage in said worm to support said worm for rotation relative to said first housing member.

35. A device as set forth in claim 34 further including a spring washer disposed between one end portion of said worm and one of said first and second walls of said first housing member, said spring washer having central opening through which said drive shaft extends, said spring washer having arcuately bowed opposite side surfaces, one of said side surfaces of said spring washer being disposed in engagement with said one end portion of said worm and one of said side surfaces of said spring washer being disposed in engagement with said one of said first and second walls of said first housing member to enable said spring washer to urge an end portion of said worm opposite from said one end portion into engagement with a wall of said first housing member opposite from said one of said first and second walls of said first housing member.

36. A device as set forth in claim 35 wherein said one end portion of said worm has a circular projection which extends into said central opening in said spring washer to position said spring washer relative to said worm.

37. A device as set forth in claim 33 wherein said first housing member includes an inner wall through which said second housing member extends and an outer wall opposite from said inner wall, said inner wall of said first housing member having a surface which engages said shank portion of said second housing member to retain said second housing member against rotation relative to said first housing member about an axis which is coincident with a central axis of said shaft.

38. A device as set forth in claim 33 wherein said shank portion of said second housing member extends through an opening in a wall of said first housing member and has a polygonal configuration.

39. A device as set forth in claim 38 wherein said head end portion of said second housing member has a polygonal configuration and is disposed in engagement with said bottom wall of said first housing member.

40. A device as set forth in claim 33 wherein an outer wall of said first housing member has a circular opening which is axially aligned with said shaft and with said shank portion of said second housing member, said circular opening in said outer wall of said first housing member having a diameter which is greater than a maximum diameter of said pinion gear to enable said pinion gear to be inserted into said first housing member through said circular opening in said outer wall of said first housing member.

41. A device for use in tuning a stringed musical instrument, said device comprising a rotatable shaft having a first end portion adapted to be connected with a string of the musical instrument and a second end portion, a pinion gear connected with the second end portion of said shaft, a worm disposed in meshing engagement with said pinion gear, said worm being rotatable to rotate said pinion gear and shaft to vary tension in the string connected with the first end portion of said shaft, a housing at least partially enclosing said worm, pinion gear and shaft, said housing having first and second walls disposed adjacent to axially opposite ends of said worm, said first wall including first surface means for defining a first circular opening, said second wall including second surface means for defining a second circular opening, said worm having a central passage which is axially aligned with said first and second circular openings, a drive shaft extending into said first and second circular openings in said first and second walls of said housing and through said passage in said worm to support said worm for rotation relative to said housing, manually engageable means connected with said drive shaft for transmitting force to said drive shaft to rotate said drive shaft and worm relative to said housing, a spring washer disposed between one end portion of said worm and one of said first and second walls of said housing, said spring washer having central opening through which said drive shaft extends, said spring washer having arcuately bowed opposite side surfaces, one of said side surfaces of said spring washer being disposed in engagement with said one end portion of said worm and one of said side surfaces of said spring washer being disposed in engagement with said one of said first and second walls of said housing to enable said spring washer to urge an end portion of said worm opposite from said one end portion into engagement with a wall of said housing opposite from said one of said first and second walls of said housing.

42. A device as set forth in claim 41 wherein said one end portion of said worm has a circular projection which extends into said central opening in said spring washer to position said spring washer relative to said worm.

43. A device as set forth in claim 41 further including a plurality of splines formed on said drive shaft, said plurality of splines being disposed in engagement with said worm to interconnect said worm and drive shaft.

44. A method of assembling a device for use in tuning a stringed musical instrument, said method comprising the steps of positioning a pinion gear in a housing with a shaft extending from the pinion gear, moving a worm and a spring washer into the housing, said step of moving the worm and spring washer into the housing being performed with the spring washer axially aligned with the worm and includes moving the worm into meshing engagement with the pinion gear and moving the spring washer into engagement with an inner side surface of the housing, and, thereafter, connecting a shaft with the worm while the worm and spring washer are disposed in the housing.

45. A method as set forth in claim 44 wherein said step of connecting the shaft with the worm includes moving an end portion of the shaft through an opening in a first wall of the housing, through the spring washer, through the worm and into engagement with a second wall of the housing.

46. A method as set forth in claim 44 wherein said step of moving the worm and spring washer into the housing is performed with an end portion of the worm extending into an opening in the spring washer.

* * * * *